US012351952B2

(12) United States Patent
Yan et al.

(10) Patent No.: US 12,351,952 B2
(45) Date of Patent: Jul. 8, 2025

(54) FULLY-FASHIONED COMPRESSION SKI SUIT KNITTED BY FOUR-NEEDLE BED, AND KNITTING METHOD OF FULLY-FASHIONED COMPRESSION SKI SUIT

(71) Applicant: Suzhou Rainbow Fashion Co., Ltd, Suzhou (CN)

(72) Inventors: Chao Yan, Suining (CN); Li Niu, Suzhou (CN); Li Zhang, Suzhou (CN); Yan Zhang, Suzhou (CN)

(73) Assignee: Suzhou Rainbow Fashion Co., Ltd, Suzhou (CN)

( * ) Notice: Subject to any disclaimer, the term of this patent is extended or adjusted under 35 U.S.C. 154(b) by 0 days.

(21) Appl. No.: 18/964,446

(22) Filed: Dec. 1, 2024

(65) Prior Publication Data

US 2025/0092584 A1 Mar. 20, 2025

(30) Foreign Application Priority Data

Jun. 17, 2024 (CN) ..... 202410777228.5

(51) Int. Cl.
*D04B 1/10* (2006.01)
*D04B 1/24* (2006.01)
*D04B 7/00* (2006.01)

(52) U.S. Cl.
CPC ..... *D04B 1/10* (2013.01); *D04B 1/24* (2013.01); *D04B 7/00* (2013.01); *D10B 2501/04* (2013.01)

(58) Field of Classification Search
CPC . D04B 1/10; D04B 1/102; D04B 1/12; D04B 1/18; D04B 1/24; D04B 1/243; D04B 1/246; D04B 7/24; D04B 7/28; A41D 1/082
See application file for complete search history.

(56) References Cited

U.S. PATENT DOCUMENTS

| | | | | |
|---|---|---|---|---|
| 2007/0168076 | A1 | 7/2007 | Manabu | |
| 2008/0189824 | A1* | 8/2008 | Rock | D04B 1/04 36/43 |
| 2008/0190147 | A1 | 8/2008 | Okamoto | |
| 2009/0173108 | A1 | 7/2009 | Okamoto | |
| 2015/0173430 | A1* | 6/2015 | Langer | A41D 13/0015 2/113 |
| 2016/0255883 | A1* | 9/2016 | Morag | A41D 13/0015 |
| 2017/0071275 | A1* | 3/2017 | Darby | A41B 17/005 |
| 2017/0099898 | A1* | 4/2017 | Pezzimenti | A41B 9/00 |
| 2017/0208882 | A1* | 7/2017 | Lambertz | B29C 39/36 |
| 2017/0295871 | A1* | 10/2017 | Sugino | A41D 1/08 |
| 2018/0325196 | A1* | 11/2018 | Miller | D06M 23/16 |
| 2021/0059333 | A1* | 3/2021 | Giorgini | A41D 31/102 |

FOREIGN PATENT DOCUMENTS

CN 113957597 A * 1/2022

* cited by examiner

*Primary Examiner* — Aiying Zhao

(74) *Attorney, Agent, or Firm* — Hemisphere Law, PLLC; Zhigang Ma

(57) ABSTRACT

A compression ski suit includes a top and trousers. The top is integrally knitted, and corresponding functional knitted structures are arranged on shoulder parts, upper arm parts, elbow parts, a chest part and a back part of the top according to functional divisions of human body parts. The trousers are integrally knitted, and corresponding functional knitted structures are arranged on outer thigh parts, inner thigh parts, knee parts and rear shank parts of the trousers according to the functional divisions of the human body parts.

10 Claims, 13 Drawing Sheets

FULLY-FASHIONED COMPRESSION SKI SUIT KNITTED BY FOUR-NEEDLE BED, AND KNITTING METHOD OF FULLY-FASHIONED COMPRESSION SKI SUIT

TECHNICAL FIELD

The present disclosure relates to the technical field of knitwear, and in particular to a compression ski suit knitted by four needle beds, and a knitting method of the compression ski suit.

BACKGROUND

Compression ski suits worn by skier competitors or skiers in sports not only can completely cover the human body surface, but also can give a certain pressure to the skin to reduce muscle shake during sports. Knitted fabrics are widely used in the field of compression suit due to their excellent fit, comfort, and stretchability. As different parts of the human body have different sweat volumes and require different support pressures in skiing, the functional requirements for compression suit are also different. However, this aspect is not considered in the design of existing compression ski suits, which leads to poor wearing experience.

SUMMARY

In order to overcome the shortcomings above, an objective of the present disclosure is to provide a compression ski suit knitted by four needle beds, and a knitting method of the compression ski suit. Through the functional division design, the wearing comfort is improved while ensuring that the compression suit has a certain pressure support.

In order to achieve the objective above, a first technical solution adopted by the present disclosure is as follows: a compression ski suit knitted by four needle beds includes a top, and trousers.

The top is integrally knitted, and corresponding functional knitted structures are arranged on shoulder parts, upper arm parts, elbow parts, a chest part and a back part of the top according to functional divisions of human body parts. The trousers are integrally knitted, and corresponding functional knitted structures are arranged on outer thigh parts, inner thigh parts, knee parts and rear shank parts of the trousers according to the functional divisions of the human body parts.

The shoulder part is provided with a first knitted structure, and the first knitted structure is a partially convex structure.

The upper arm part is provided with a second knitted structure, and the second knitted structure is a pore structure having an inverted V-shape pattern.

The elbow part is provided with a third knitted structure, and the third knitted structure is a partially pleated structure.

The chest part is provided with a fourth knitted structure, a fifth knitted structure and a sixth knitted structure from the chest to a body side. The fourth knitted structure, the fifth knitted structure and the sixth knitted structure are all pore structures, and pressure of the fourth knitted structure, the fifth knitted structure and the sixth knitted structure on the human skin surface is reduced in turn.

The back part is provided with a seventh knitted structure, and the seventh knitted structure is a pore structure.

The outer thigh part is provided with an eighth knitted structure, and the eighth knitted structure is a strip structure.

The inner thigh part is provided with a ninth knitted structure, and the ninth knitted structure is a thickened pore structure.

The knee part is provided with a tenth knitted structure, an eleventh knitted structure, and a twelfth knitted structure. The tenth knitted structure is arranged at a front side of the knee part and is a double-layer knitted structure, the eleventh knitted structure is located on both sides of the knee part and is a convex structure, and the twelfth knitted structure is located at a rear side of the knee part and is a partially pleated structure.

The rear shank part is provided with a thirteenth knitted structure, and the thirteenth knitted structure is a compact jacquard knitted structure.

The compression ski suit provided by the present disclosure has the beneficial effects that:

Each of the top and the trousers is integrally knitted, which can reduce the labor cost increased by later linking, reduce indentation and uncomfortable feeling caused by the existence of seams at connections, and ensure the overall fit of the compression suit. Secondly, according to the functional divisions of human body parts, functional knitted structures are arranged at the corresponding parts of the top and the trousers, which can enrich the knitted structure of the compression ski suit, and avoid the problem of poor wearing experience caused by a situation that the single knitted structure cannot adapt to different needs of various parts of the clothing in skiing.

The partially convex structure and the convex structure can keep the human skin in incomplete contact with the clothing, and then achieve the effect of pressure reduction. The pore structures can achieve air and moisture permeability through the pore spaces between the knitted structures (the inverted V-shape pattern can form a guide channel in the inner layer of the knitted structures to facilitate the discharge of sweat, and the thickened pore structures can further enhance the structural strength of the knitted structures). The partially pleated structure can ensure the effect of multi-angle large-amplitude bending at the joint through large stretching amount. The strip structure can increase the transverse tensile properties of the knitted structures. The double-layer knitted structure and the jacquard knitted structures can increase the structural strength of the knitted structures to achieve safety protection.

Further, the pore structure is formed by using a stitch transfer process, or a loop transfer process.

Further, the first knitted structure is knitted by surface yarns and inner yarns with different shrinkage ratios to form a partially convex three-dimensional structure that is partially detached from human skin, thus reducing the pressure on the shoulder when the ski suit is worn, and ensuring the pressure comfort of shoulders when the ski suit is worn for a long time.

Further, pore sizes of the fourth knitted structure, the fifth knitted structure and the sixth knitted structure are reduced in turn. Because the sweat volume from the chest to the body side of the human body decreases gradually, the clothing at the chest part can be adaptively adjusted according to the actual sweat volume on the human chest by limiting the pores of the fourth knitted structure, the fifth knitted structure and the sixth knitted structure, so as to ensure the thermal-wet comfort of the chest part.

Further, inner yarns of the fourth knitted structure, the fifth knitted structure and the sixth knitted structure are added with elastic yarns, and addition amounts of the elastic yarns in the fourth knitted structure, the fifth knitted structure and the sixth knitted structure are reduced in turn, thus forming a pressure gradient in which the pressure gradually decreases from the chest to the body side. Through the addition of the elastic yarns, a pressure gradient can be formed at the chest part to ensure the pressure comfort when the ski suit is worn.

Further, inner yarns of the tenth knitted structure are added with elastic yarns and wear-resistant yarns, and the wear-resistant yarn includes polyethylene fiber, or polyamide fiber, thus enhancing the supporting force on the front side of the knee and prolonging the wearing life.

Further, the elastic yarns include include at least one of polyurethane fiber, polyolefin elastic fiber, T400 composite fiber, polybutylene terephthalate fiber, polytrimethylene tereph-thalate, polyamide-wrapped polyurethane fiber, and polyesterwrapped polyurethane fiber.

A second technical solution adopted by the present disclosure is a knitting method of the fully fashioned compression ski suit knitted by four needle beds above. Each of a top and trousers is integrally knitted and fashioned using a flat knitting machine with four needle beds.

The knitting method of the compression ski suit provided by the present disclosure has the beneficial effects that:

Each of the top and the trousers is integrally knitted, which can reduce indentation and uncomfortable feeling caused by the existence of seams at connections, ensure the overall fit of the compression suit, and reduce the labor cost increased by later linking. Functional knitted structures are arranged at the corresponding parts of the top and the trousers to achieve functional division of the compression ski suit, which can enrich the knitted structure of the compression ski suit, and avoid the problem of poor wearing experience caused by a situation that the single knitted structure cannot adapt to different needs of various parts of the clothing in skiing.

Further, the top includes a body, a left sleeve, and a right sleeve. Two yarn feeders are used for each of the body, the sleeve, and the right sleeve. surface yarns are fed into one yarn feeder, inner yarns are fed into the other yarn feeder, and then knitting is carried out from bottom to top. The trousers include a left trouser leg, and a right trouser leg. Two yarn feeders are used for each of the left trouser leg and the right trouser leg. Surface yarns are fed into one yarn feeder, inner yarns are fed into the other yarn feeder, and then knitting is carried out from bottom to top.

Further, a seamless connection is formed at a junction of the body and each of the left sleeve and the right sleeve through loop transfers during knitting; and a seamless connection is formed at a junction of the left trouser leg and the right trouser leg through loop transfers during knitting.

1—first knitted structure; 2—second knitted structure; 3—third knitted structure; 4—fourth knitted structure; 5—fifth knitted structure; 6—sixth knitted structure; 7—seventh knitted structure; 8—eighth knitted structure; 9—ninth knitted structure; 10—tenth knitted structure; 11—eleventh knitted structure; 12—twelfth knitted structure.

DETAILED DESCRIPTION OF THE EMBODIMENTS

In the following, the preferred embodiments of the present disclosure will be described in detail with the accompanying drawings, such that the advantages and features of the present disclosure can be more easily understood by those skilled in the art, and the scope of protection of the present disclosure can be more clearly defined.

Embodiment

In order to facilitate the following description, various parts of the human body are distinguished. The human body is mainly divided into trunk, upper limbs, and lower limbs. The trunk includes shoulders, chest, waist and abdomen, and back. The upper limbs include upper arms, elbows and lower arms. The lower limbs include hips, thighs, knees, and shanks. The junction of the trunk and the upper limb is located at armpit.

Figure 1:
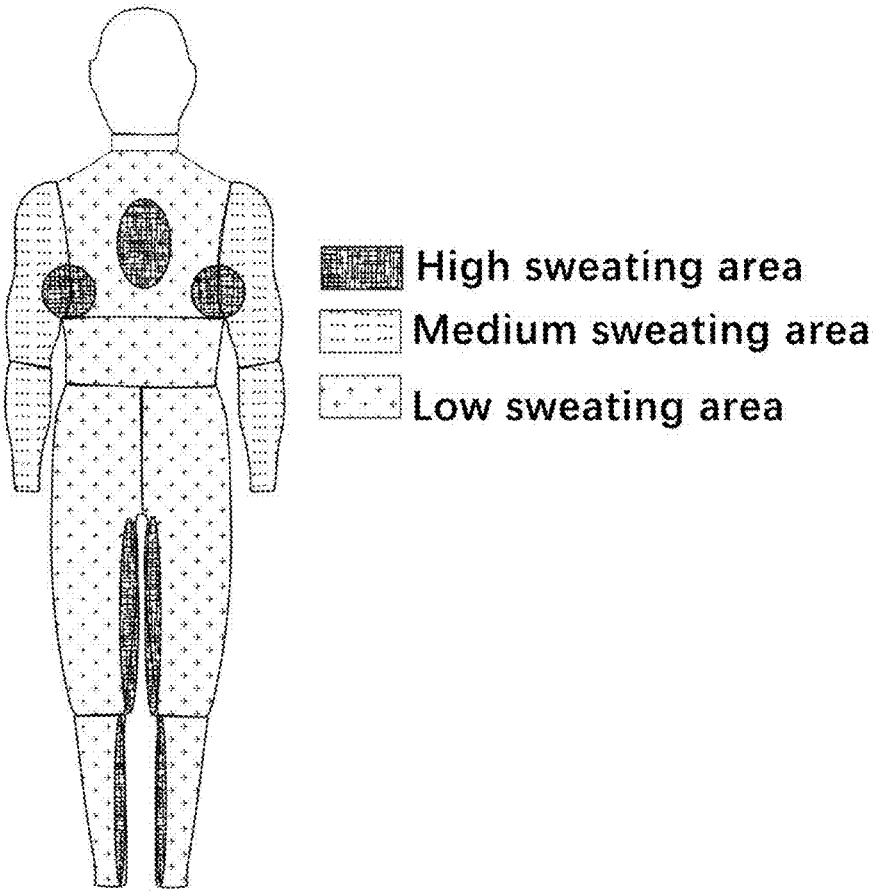
FIG. 1 is a schematic diagram showing divisions of human body parts based on sweat volume according to an embodiment of the present disclosure.

As different parts of the human body have different sweat volumes and require different support pressures in skiing, the human body parts are divided into function divisions. Specifically, there are two ways for functional dividing. The first way is to divide various parts of the human body into a high sweating area, a medium sweating area, and a low sweating area according to the distribution of sweat glands on the surface of human skin. As shown in FIG. 1, underarms, the chest, the back, the inner thighs and the inner shanks are high sweating areas, the rest parts of the trunk and thighs are medium sweating areas, and the upper limbs and the shanks are low sweating areas. Based on this, in order to improve the wearing comfort of the compression suit, thermal-wet comfort design should be carried out in the high sweating area and the medium sweating area during wearing.

Figure 2:
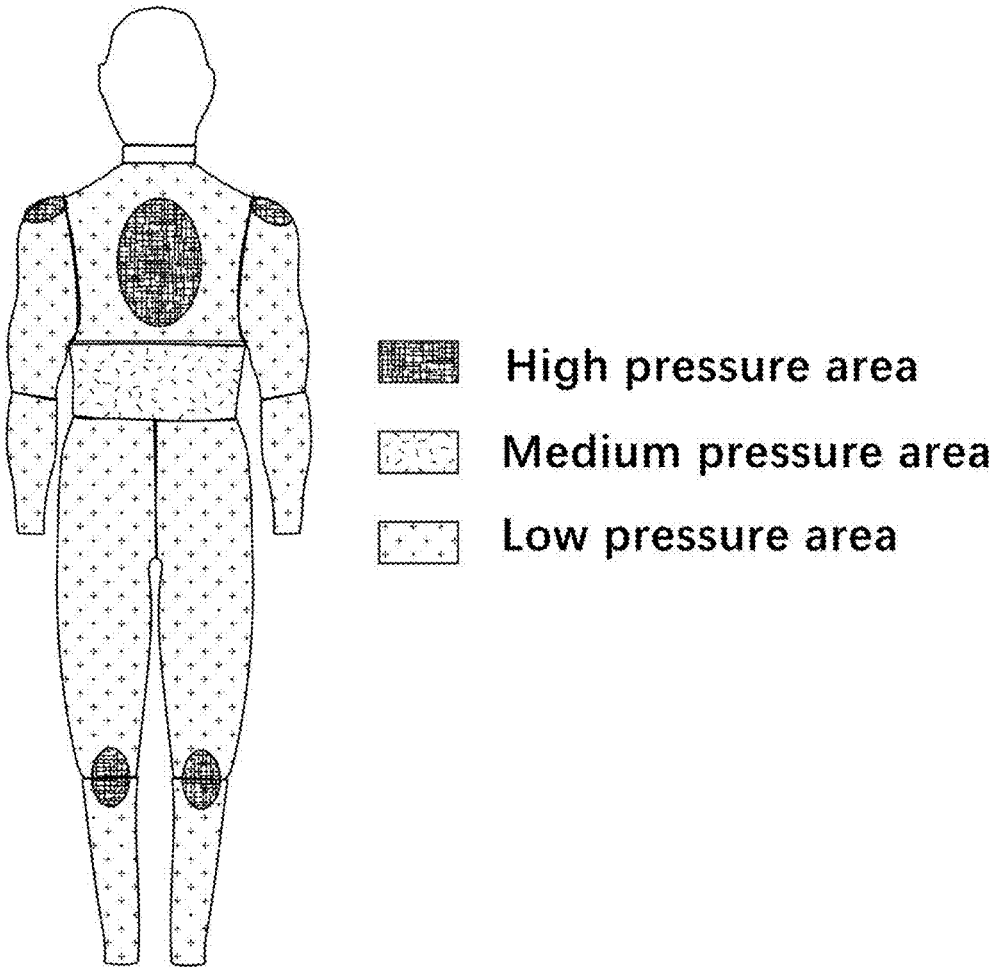
FIG. 2 is a schematic diagram showing divisions of human body parts based on pressure according to an embodiment of the present disclosure.

The second is to divide all parts of the human body into a high pressure area, a medium pressure area and a low pressure area according to the comfortable pressure threshold of the surface of the human skin and the contractility of muscles in different parts of the body during exercise. As shown in FIG. 2, the shoulders, the chest and the knees are high pressure areas, the upper arms and the rest of the trunk are medium pressure areas, and the lower arms and lower limbs are low pressure areas. Based on this, in order to improve the wearing comfort of the compression suit, the pressure comfort design should be carried out in the high pressure area and the medium pressure area in the designing.

In addition, in skiing, the joints of the knees and the elbows are bent to a great extent, the friction of the inner thigh is serious, and the muscles at the outer thigh and the rear shank bulge greatly. Therefore, the compression suit needs to be designed for safety protection of the knees, the elbows, the inner thighs, the outer thighs, and the rear shanks.

Based on the above function division of the human body parts, as shown in FIG. 3-FIG. 13, a fully-formed compression ski suit knitted by four needle beds of the present disclosure includes a top, and trousers. Each of a top and trousers is integrally knitted.

Figure 3:
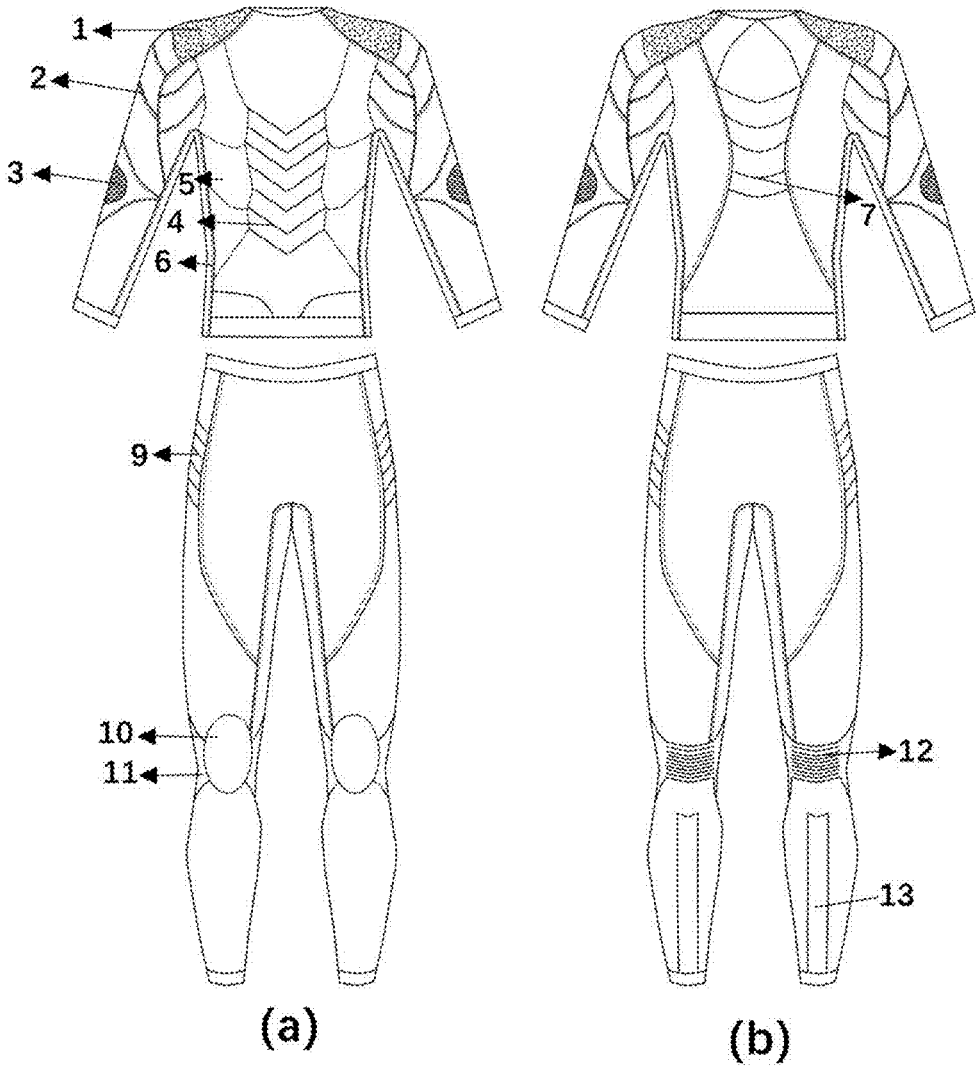
FIG. 3 is a division design diagram of a compression ski suit according to an embodiment of the present disclosure, in which FIG. 3(*a*) is a front side of the compression ski suit, and FIG. 3(*b*) is a back side of the compression ski suit.
Figure 4:
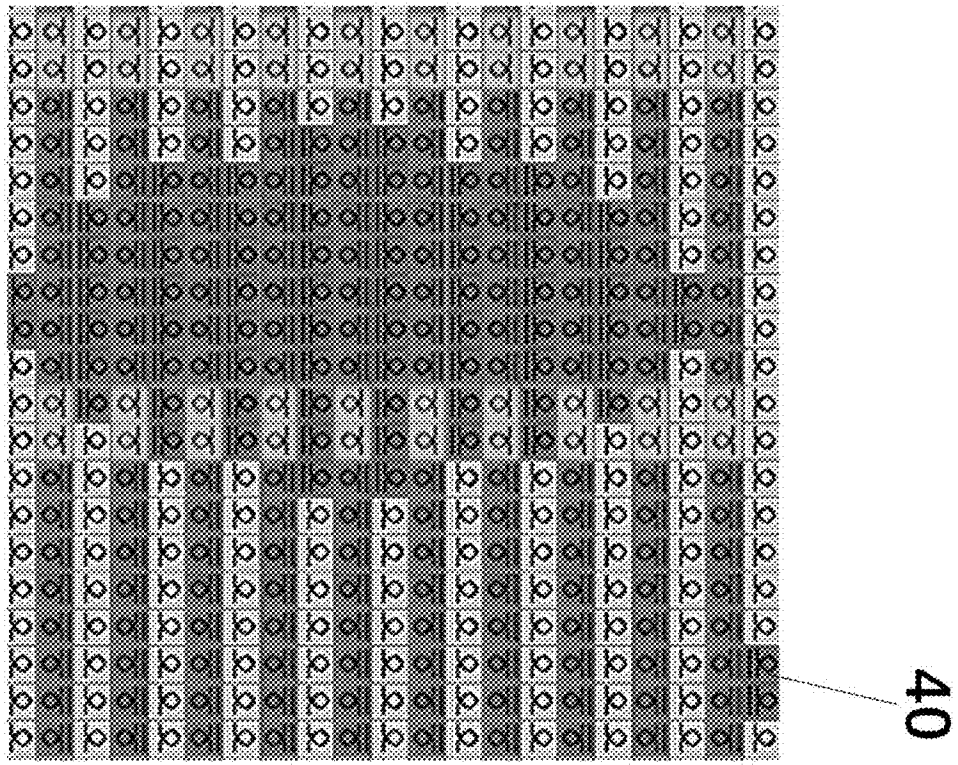
FIG. 4 is a partial knitting diagram of a first knitted structure according to an embodiment of the present disclosure.

As shown in FIG. 3, in the top, according to the functional division of the human body parts, corresponding functional knitted structures are arranged on shoulder parts, upper arm parts, elbow parts, a chest part and a back part of the top, and the rest parts adopt the basic knitted structures in the prior art, specifically as follows:

(1) The shoulder part is located at the high pressure area, and thus the purpose of reducing pressure should be achieved in the design. Specifically, as shown in FIG. 4, the shoulder part is provided with a first knitted structure. The first knitted structure is knitted by surface yarns and inner yarns with different shrinkage ratios to form a partially convex three-dimensional structure 40 that is partially detached from human skin. Through the partially convex structural features, the pressure on the shoulder can be reduced when the ski suit is worn, and the pressure comfort of wearing for a long time can be ensured.

Figure 5:
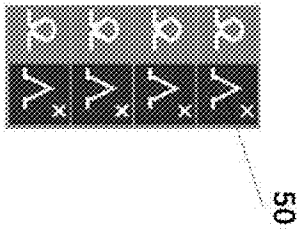
FIG. 5 is a partial knitting diagram of a second knitted structure according to an embodiment of the present disclosure.

(2) The upper arm part is located at the medium pressure area, and the armpit is located at a high sweating area. Therefore, the design should focus on the moisture drainage of sweat at the armpit. Specifically, as shown in FIG. 5, the upper arm part is provided with a second knitted structure, the second knitted structure is a pore structure having an inverted V-shape pattern 50. The pore effect is achieved through a tuck stitching process, or a loop transfer processes. Through bionic design of inverted V-shapes, a water channel is formed in the inner layer of the second knitted structure (that is, the side close to human skin) to guide the sweat at the armpit from the inner layer of the second knitted structure.

Figure 6:
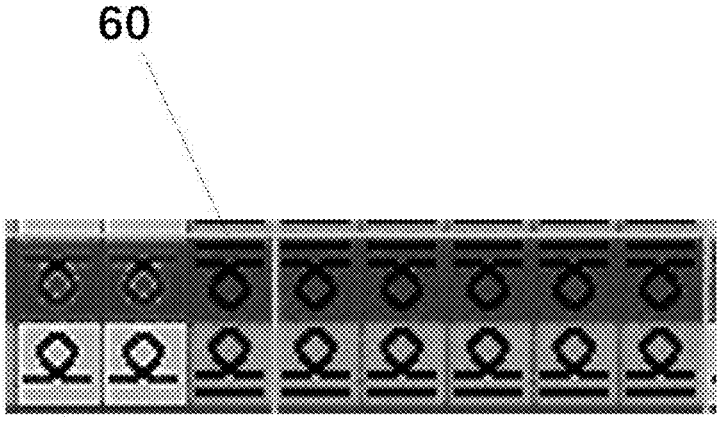
FIG. 6 is a partial knitting diagram of a third knitted structure and a twelfth knitted structure according to an embodiment of the present disclosure.

(3) The elbow part is provided with a third knitted structure. As shown in FIG. 6, the third knitted structure is a partially pleated structure 60 to provide sufficient motion margin to adapt to the large stretching amount at the joint, thus ensuring the degree of freedom of multi-angle bending at the joint.

Figure 7:
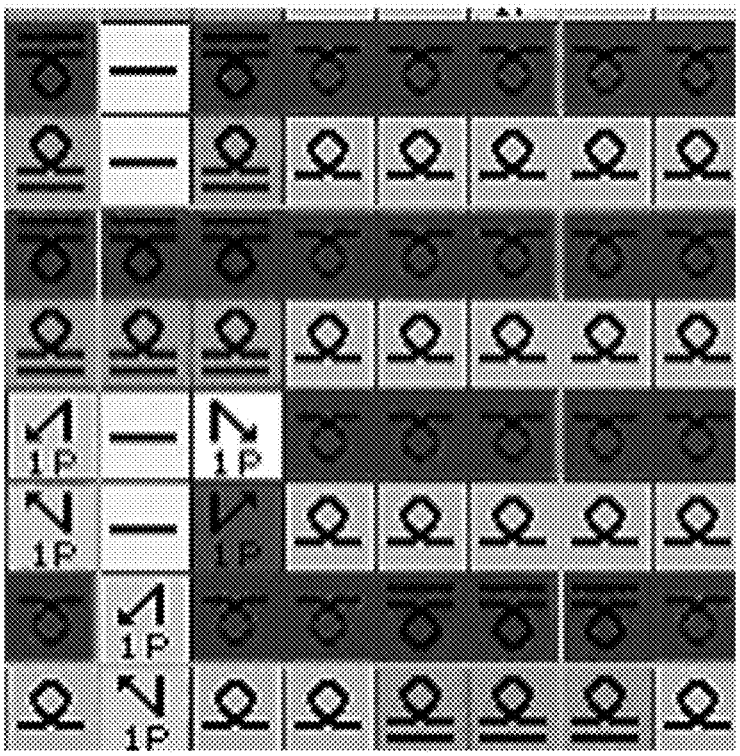
FIG. 7 is a partial knitting diagram of a fourth knitted structure, a fifth knitted structure, a sixth knitted structure, and a seventh knitted structure according to an embodiment of the present disclosure.

(4) The chest part is located at the high sweating area and the high pressure region, and thus both thermal-wet comfort and pressure comfort should be taken into account in the design. Specifically, as shown in FIG. 7, the chest part is provided with a fourth knitted structure, a fifth knitted structure and a sixth knitted structure from the chest to a body side. The fourth knitted structure, the fifth knitted structure and the sixth knitted structure are pore structures formed by using a stitch transfer process or a loop transfer process, and pore sizes of the fourth knitted structure, the fifth knitted structure and the sixth knitted structure are reduced in turn. The surface yarns of the fourth knitted structure, the fifth knitted structure and the sixth knitted structure are wool yarns to improve the warmth retention property of the ski suit, and the inner yarns are moisture-wicking fiber yarns.

In order to improve pressure comfort, a certain proportion of elastic yarns is added in the inner yarns of the fourth knitted structure, the fifth knitted structure and the sixth knitted structure, and the addition amount of the elastic yarns in the fourth knitted structure, the fifth knitted structure and the sixth knitted structure decreases in turn, thus forming a pressure gradient that the pressure gradually decreases from the chest to the body side.

(5) The back part is located the high sweating area and the medium pressure area, and thus both thermal-wet comfort and pressure comfort should be taken into account in the design. Specifically, as shown in FIG. 7, the back part is provided with a seventh knitted structure, and the seventh knitted structure is a pore structure. A certain proportion of elastic yarns is added in the inner yarns of the seventh knitted structure, thus making the back part form a pressure gradient that the pressure gradually decreases from the middle to the body side.

It should be noted that the seventh knitted structure, the fourth eave structure, the fifth knitted structure and the sixth knitted structure are all pore structures imitating leaf pores. After human motion, the muscles bulge, and the pore sizes in the fabric also change accordingly, thus achieving the purpose of dynamically adjusting human heat balance and achieving body thermal management.

Figure 8:
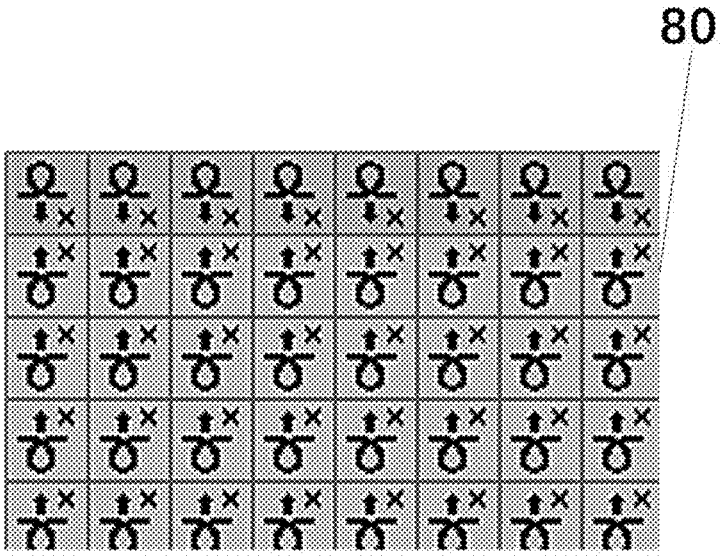
FIG. 8 is a partial knitting diagram of an eighth knitted structure according to an embodiment of the present disclosure.

As shown in FIG. 3, in the trousers, according to the functional division of the human body parts, corresponding functional knitted structures are arranged on outer thigh parts, inner thigh parts, knee parts, and rear shank parts of the trousers, and the rest parts adopt the basic knitted structures in the prior art, specifically as follows:

(1) The muscles on the outer thigh will bulge after exercise, and thus the outer thigh part is provided with an eighth knitted structure. As shown in FIG. 8, the eighth knitted structure is a strip structure 80, which can provide sufficient space structure for muscle stretching and ensures the wearing comfort during exercise.

Figure 9:
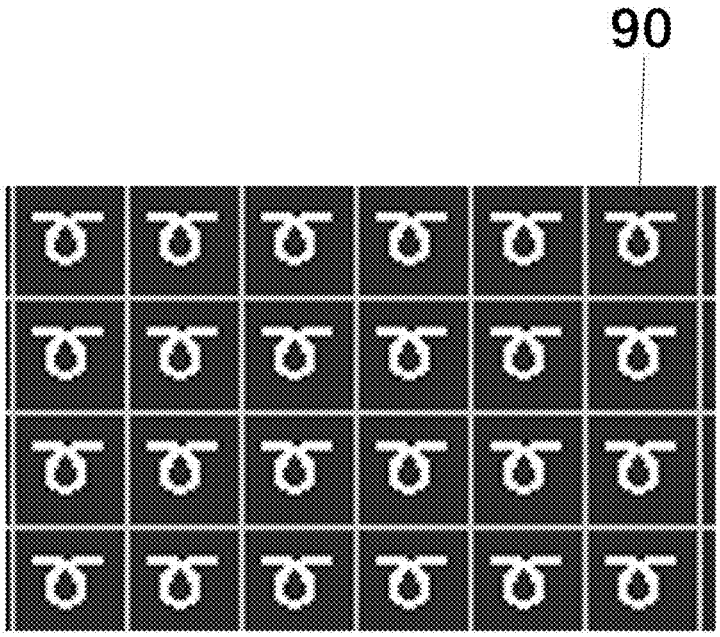
FIG. 9 is a partial knitting diagram of a ninth knitted structure according to an embodiment of the present disclosure.

(2) The inner thigh is located at the high sweating area, and has serious friction during exercise. Therefore, both thermal-wet comfort and pressure comfort should be taken into account in design. Specifically, the inner thigh part is provided with a ninth knitted structure. As shown in FIG. 9, the ninth knitted structure includes is a pore structure 90 having a greater thickness than that in areas adjoining the ninth knitted structure. The inner yarn is a moisture-wicking yarn, and the surface yarn is a yarn with a low friction coefficient.

Figure 10:
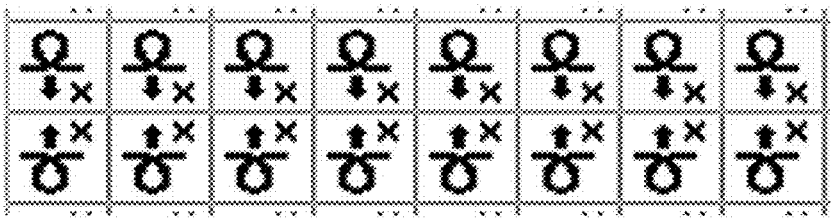
FIG. 10 is a partial knitting diagram of a tenth knitted structure according to an embodiment of the present disclosure.
Figure 11:
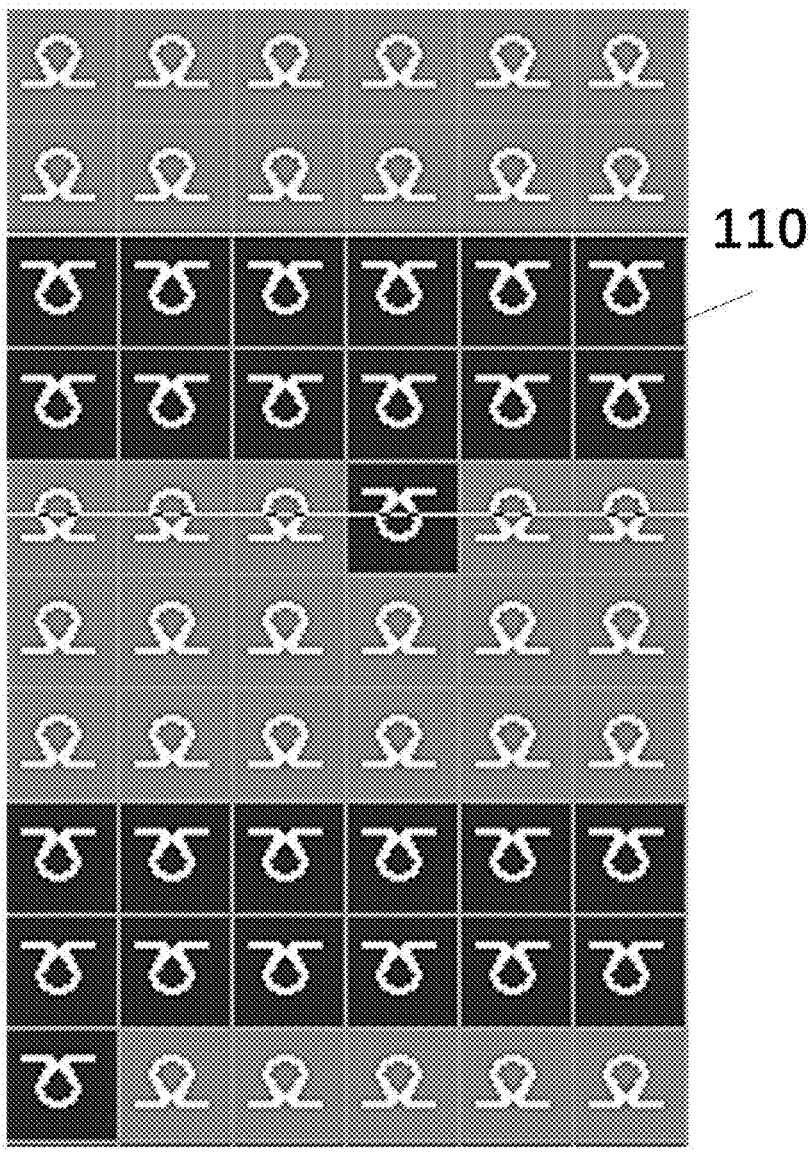
FIG. 11 is a partial knitting diagram of an eleventh knitted structure according to an embodiment of the present disclosure.

(3) The knee is located at the high pressure area, and the knee joint moves and bends more. Therefore, pressure comfort and safety protection should be taken into account in the design. Specifically, the knee part is provided with a tenth knitted structure, an eleventh knitted structure, and a twelfth knitted structure. As shown in FIG. 6, FIG. 10 and FIG. 11, the tenth knitted structure is located at the front side of the knee part, and is a double-layer knitted structure. Elastic yarns and wear-resistant yarns are added in the inner yarns to adjust the pressure and service life of the fabric. The eleventh knitted structure is located on both sides of the knee part, and is a three-dimensional convex structure 110, which is in incomplete contact with the skin to guarantee the wearing comfort. The content of the elastic yarns in the eleventh knitted structure is greater than that in the tenth knitted structure, thus enhancing supporting pressure on both sides of the knee. The twelfth knitted structure is located on the rear side of the knee part, which has the same structure as the third knitted structure, and is a partially pleated structure.

Figure 12:
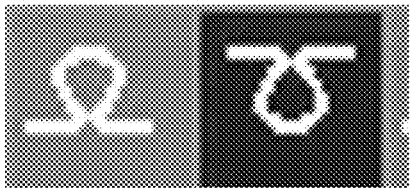
FIG. 12 is a partial knitting diagram of a thirteenth knitted structure according to an embodiment of the present disclosure.
Figure 13:
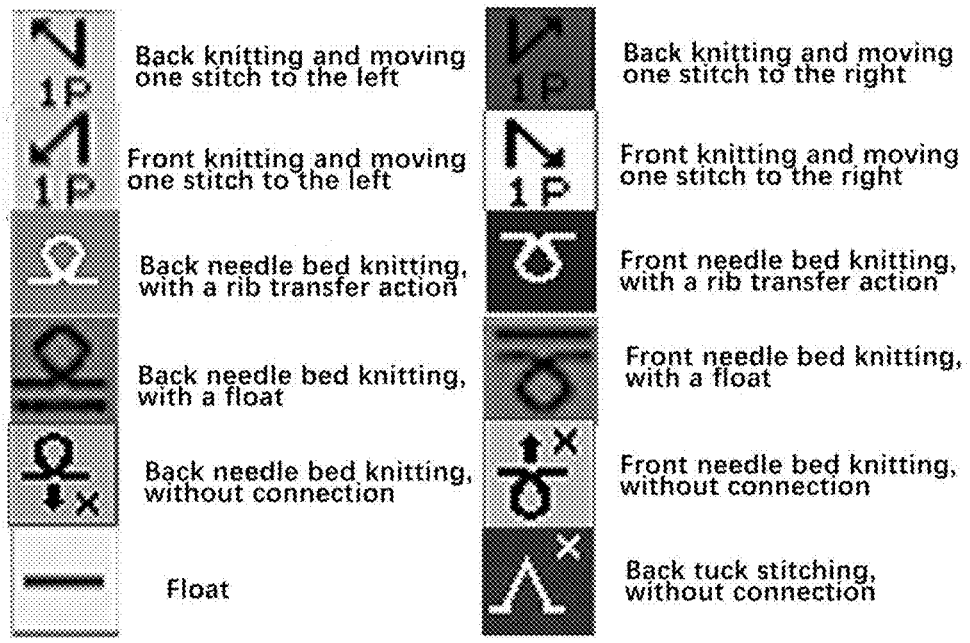
FIG. 13 is an explanation of the icons in FIG. 4 to FIG. 12.

(4) The muscles at the rear shank will bulge during exercise, the rear shank part is provided with a thirteenth knitted structure, as shown in FIG. 12, which is a compact jacquard knitted structure to enhance the supporting pressure on the rear shank.

In some embodiments, at least one of cotton, linen, silk, hair (wool, rabbit hair, etc.), viscose, polyester, polyamide, polyvinyl alcohol, polyurethane, etc. can be selected for the surface yarn and the inner yarn according to actual needs. The elastic yarns may be at least one of polyurethane fiber (PU), polyolefin elastic fiber (XLA), T400 composite fiber, polybutylene terephthalate fiber (PBT), polytrimethylene tereph-thalate fiber (PTT), polyamide-wrapped polyurethane fiber, and polyester-wrapped polyurethane fiber. The wear-resistant yarn may be at least one of ultrahigh-molecular-weight polyethylene fiber, and polyamide fiber.

The present disclosure further provides a knitting method of a compression ski suit. A flat knitting machine with four needle beds is used to knit the top and the trousers, respectively, where the knitting speed does not exceed 0.8 mis. When knitting the top, two yarn feeders are used for each of the body, the sleeve, and the right sleeve. Surface yarns are fed into one yarn feeder, inner yarns are fed into the other yarn feeder, and then knitting is carried out from bottom to top. When knitting the trousers, two yarn feeders are used for each of the left trouser leg and the right trouser leg. Main-Surface yarns are fed into one yarn feeder, inner yarns are fed into the other yarn feeder, and then knitting is carried out from bottom to top.

A curve shape in fit with the human body is formed at the junction of the body and each of the left sleeve and the right sleeve, and the junction of the left trouser leg and the right trouser leg through cast on and bind off, and then a seamless connection is formed through loop transfers during knitting.

During knitting, when involving in partial knitting or wrapping-turning action, the edge part is knitted by stitch transferring and thread pressing instead of using a hanging eye process, which can reduce the requirements for the size of the pattern.

Furthermore, after the knitting of the top and the trousers, the top and the trousers need to be subjected to after-treatment processes such as washing, and ironing and pressing.

In the present disclosure, the knitting of the compression ski suit is achieved by the four needle be the flat knitting machine with four needle beds, and the functional knitted structure for pressure comfort, thermal-wet comfort and safety protection is introduced into the compression ski suit according to the sweat volumes, skin pressure thresholds and motion characteristics of different parts of human body, such that the compression ski suit may have pressure comfort, thermal-wet comfort and safety protection, and the knitted structure of the compression ski suit is enriched, and the problem that a single knitted structure cannot adapt to different functional requirements of different parts of the compression ski suit in skiing can be avoided. The knitting can avoid the indentation and uncomfortable wearing caused by the connection of knitting pieces, and improve the fit of the clothing to a certain extent.

The above embodiments are only for describing the technical concept and characteristics of the present disclosure, with the purpose of making those skilled in the art understand and implement the content of the present disclosure, rather than limiting the scope of protection of the present disclosure. All equivalent changes or modifications made according to the spirit of the present disclosure should be included in the scope of protection of the present disclosure.

What is claimed is:

1. A compression ski suit knitted by four needle beds, comprising a top and trousers, wherein the top is integrally knitted, and corresponding functional knitted structures are arranged on shoulder parts, upper arm parts, elbow parts, a chest part and a back part of the top according to functional divisions of human body parts; the trousers are integrally knitted, and corresponding functional knitted structures are arranged on outer thigh parts, inner thigh parts, knee parts and rear shank parts of the trousers according to the functional divisions of the human body parts;

the shoulder parts are provided with a first knitted structure, and the first knitted structure is a partially convex structure;

the upper arm parts are provided with a second knitted structure, and the second knitted structure is a pore structure having an inverted V-shape pattern;

the elbow parts are provided with a third knitted structure, and the third knitted structure is a partially pleated structure;

the chest part is provided with a fourth knitted structure, a fifth knitted structure and a sixth knitted structure from the chest to a body side; the fourth knitted structure, the fifth knitted structure and the sixth knitted structure are all pore structures, and pressure of the fourth knitted structure, the fifth knitted structure and the sixth knitted structure when being worn on a human skin surface is reduced in turn;

the back part is provided with a seventh knitted structure, and the seventh-knitted structure is a pore structure;

the outer thigh parts are provided with an eighth knitted structure, and the eighth knitted structure is a regular transverse strip structure;

the inner thigh parts are provided with a ninth knitted structure, and the ninth knitted structure is a thickened pore structure having a greater thickness than that in areas adjoining the ninth knitted structure;

the knee parts are provided with a tenth knitted structure, an eleventh knitted structure, and a twelfth knitted structure, wherein the tenth knitted structure is arranged at a front side of the knee part and is a double-layer-knitted structure, the eleventh knitted structure is located on both sides of the knee part and is a dot-like convex structure, and the twelfth knitted structure is located at a rear side of the knee part and is a partially pleated structure; and the rear shank parts are provided with a thirteenth knitted structure, and the thirteenth knitted structure is a jacquard-knitted structure.

2. The compression ski suit knitted by four needle beds according to claim 1, wherein all the pore structures are formed by using a stitch transfer process, or a loop transfer process.

3. The compression ski suit knitted by four needle beds according to claim 1, wherein the first knitted structure is knitted by surface yarns and inner yarns with different shrinkage ratios to form the partially convex structure that is configured to be partially detached from human skin.

4. The compression ski suit knitted by four needle beds according to claim 1, wherein pore sizes of the fourth knitted structure, the fifth knitted structure and the sixth knitted structure are reduced in turn.

5. The compression ski suit knitted by four needle beds according to claim 4, wherein inner yarns of the fourth knitted structure, the fifth knitted structure and the sixth knitted structure are added with elastic yarns, and amounts of the elastic yarns in the fourth knitted structure, the fifth knitted structure and the sixth knitted structure are reduced in turn, thus forming a pressure gradient in which the pressure gradually decreases from the chest to the body side.

6. The compression ski suit knitted by four needle beds according to claim 1, wherein inner yarns of the tenth knitted structure are added with elastic yarns and wear-resistant yarns, and the wear-resistant yarn comprises polyethylene fiber, or polyamide fiber.

7. The compression ski suit knitted by four needle beds according to claim 5, wherein the elastic yarns comprise at least one of polyurethane fiber, polyolefin elastic fiber, polybutylene terephthalate fiber, polytrimethylene terephthalate, polyamide-wrapped polyurethane fiber, and polyester-wrapped polyurethane fiber.

8. A knitting method of the compression ski suit knitted by four needle beds according to claim 1, wherein each of a top and trousers is integrally knitted using flat knitting machine with four needle beds.

9. The knitting method according to claim 8, wherein the top comprises a body, a left sleeve, and a right sleeve; two yarn feeders are used for each of the body, the left sleeve and the right sleeve; surface yarns are fed into one yarn feeder, inner yarns are fed into the other yarn feeder, and then knitting is carried out from a lower end of a corresponding one of the body, the left sleeve and the right sleeve to an upper end of the corresponding one of the body, the left sleeve and the right sleeve; and the trousers comprise a left trouser leg, and a right trouser leg; two yarn feeders are used for each of the left trouser leg and the right trouser leg; surface yarns are fed into one yarn feeder, inner yarns are fed into the other yarn feeder, and then knitting is carried out from a lower end of a corresponding one of the left trouser leg and the right trouser leg to an upper end of the corresponding one of the left trouser leg and the right trouser leg.

10. The knitting method according to claim 9, wherein a seamless connection is formed at a junction of the body and each of the left sleeve and the right sleeve through loop transfer during knitting; and a seamless connection is formed at a junction of the left trouser leg and the right trouser leg through loop transfer during knitting.

* * * * *